US012774855B2

(12) United States Patent
Ye et al.

(10) Patent No.: US 12,774,855 B2
(45) Date of Patent: Oct. 27, 2026

(54) VARIABLE FLOW HEAT EXHANGER

(71) Applicants: MAHLE International GmbH, Stuttgart (DE); MAHLE Automotive Technologies (China) Co., Ltd., Shanghai (CN)

(72) Inventors: Feiyang Ye, Shanghai (CN); Chunjiang Lu, Shanghai (CN); Dongliang Zhao, Shanghai (CN)

(73) Assignees: Mahle International GmbH (DE); MAHLE Automotive Technologies (China) Co., Ltd. (CN)

( * ) Notice: Subject to any disclaimer, the term of this patent is extended or adjusted under 35 U.S.C. 154(b) by 612 days.

(21) Appl. No.: 18/144,167

(22) Filed: May 5, 2023

(65) Prior Publication Data

US 2024/0003633 A1 Jan. 4, 2024

(30) Foreign Application Priority Data

May 6, 2022 (CN) ..... 202210486618.8

(51) Int. Cl.
*F28D 9/00* (2006.01)
*F01P 3/00* (2006.01)
(Continued)

(52) U.S. Cl.
CPC ..... *F28D 9/0043* (2013.01); *F28F 3/08* (2013.01); *F28F 13/06* (2013.01);
(Continued)

(58) Field of Classification Search
CPC .. F28D 9/005; F28D 9/0043; F01P 2003/006; F01P 2003/008; F01P 2007/146
See application file for complete search history.

(56) References Cited

U.S. PATENT DOCUMENTS 4,798,242 A * 1/1989 Kito ..... F28F 27/02 165/103
11,656,032 B2 * 5/2023 Yang ..... H01M 8/10 165/178
(Continued)

FOREIGN PATENT DOCUMENTS

DE 102004016506 B4 * 8/2013 ..... F28F 27/02
GB 1558575 A * 1/1980 ..... F28F 3/083
WO WO-2018053082 A1 * 3/2018 ..... F16H 57/0417

OTHER PUBLICATIONS

Translation of DE102004016506B4 named TRANSLATION-DE102004016506B4 (Year: 2013).*

*Primary Examiner* — Paul Alvare
(74) *Attorney, Agent, or Firm* — Fishman Stewart PLLC

(57) ABSTRACT

A variable flow heat exchanger may include a housing and a heat exchange core. The housing may include a first housing and a second housing. The heat exchange core may be arranged between the first housing and the second housing. The heat exchange core may be formed by superposition of multi-layer heat exchange plates. A cooling fluid interface may be arranged on the first housing. A cooled fluid interface may be arranged on the second housing. The cooled fluid interface may include a first interface, a second interface, and a third interface. In a first state, a cooled fluid may flow into the heat exchange core from the first interface and may flow out of the second interface. In a second state, the cooled fluid may flow into the heat exchange core from the first interface and the second interface, respectively, and may flow out of the third interface.

20 Claims, 5 Drawing Sheets

(51) Int. Cl.
*F01P 7/14* (2006.01)
*F28F 3/08* (2006.01)
*F28F 13/06* (2006.01)

(52) U.S. Cl.
CPC ... *F01P 2003/006* (2013.01); *F01P 2003/008* (2013.01); *F01P 2007/146* (2013.01); *F28D 9/005* (2013.01)

(56) References Cited

U.S. PATENT DOCUMENTS

| | | | | |
|---|---|---|---|---|
| 2007/0089871 | A1* | 4/2007 | Andersson | F28D 9/005 165/167 |
| 2012/0168138 | A1* | 7/2012 | Myers | F28F 27/02 165/200 |
| 2012/0273177 | A1* | 11/2012 | Kim | F01M 5/002 165/164 |
| 2013/0146246 | A1* | 6/2013 | Kim | F02M 21/0212 165/41 |
| 2016/0010929 | A1* | 1/2016 | Takahashi | F28D 9/02 165/166 |
| 2016/0320141 | A1* | 11/2016 | Barfknecht | F28D 9/005 |
| 2018/0135916 | A1* | 5/2018 | Sueyoshi | B60H 1/00342 |
| 2019/0063846 | A1* | 2/2019 | Bluetling | F28D 9/0093 |

* cited by examiner

VARIABLE FLOW HEAT EXHANGER

CROSS-REFERENCE TO RELATED APPLICATIONS

This application claims priority to Chinese Patent Application No. 202210486618.8, filed on May 6, 2022, the contents of which is hereby incorporated by reference in its entirety.

TECHNICAL FIELD

The application belongs to the technical field of auto parts, and relates to a cooler, in particular to a variable flow heat exchanger and a powertrain.

BACKGROUND

At present, the conventional vehicle oil cooler in the market mostly adopts the plate fin type oil cooler. Its function is to disturb the flowing hot oil in the core and fin through the structural design of the core and fin, and to cool the oil through heat exchange between the cooling water and the oil, so as to keep it within the appropriate temperature range, ensure that the engine oil has sufficient viscosity, and maintain the lubrication of relevant engine moving parts.

The existing vehicle oil cooler is designed with a single fluid flow mode, that is, the inlet, outlet and flow direction of the flow medium are certain. However, when the actual vehicle cooling system operates under different working conditions, the internal medium flow will vary greatly. At present, the conventional oil cooler design cannot change its own process according to the system flow changes, resulting in the cooling efficiency of the cooler being reduced or the energy consumption being increased.

SUMMARY

The technical solution of the application has at least the following beneficial effects:

In the embodiment of the application, the variable flow heat exchanger provided includes a shell and a heat exchange core. The second shell in the shell is provided with a first interface, a second interface and a third interface. According to the requirements of different working conditions, the first interface, the second interface and the third interface can be independently used as the inlet of the cooled fluid or the outlet of the cooled fluid or closed to realize the switching of different modes. Thus, by making the cooled fluid interface include the first interface, the second interface and the third interface in the application, the multiple interfaces can be used to communicate with the engine or transmission in the vehicle respectively, and each interface can be redefined as the cooled fluid inlet, the cooled fluid outlet or closed according to the requirements of the cooling system; Different modes can be switched according to the position change of the inlet and outlet of the cooled fluid. For example, the flow mode of the cooled fluid in the first state is suitable for small flow conditions and can improve the heat exchange; the flow mode of the cooled fluid in the second state is suitable for large flow conditions and can reduce the flow resistance.

The invention can realize the function of changing the internal process of the cooling system through mode switching, so as to match different operating conditions, optimize the overall performance of the vehicle cooling system, and finally achieve the effect of reducing energy consumption.

The variable flow heat exchanger structure of the application can take into account the requirements of different working conditions for the cooling system.

Additional aspects and advantages of the present application will be given in part in the following description, and some will become apparent from the following description, or will be known through the practice of the present invention.

DETAILED DESCRIPTION

Figure 1:
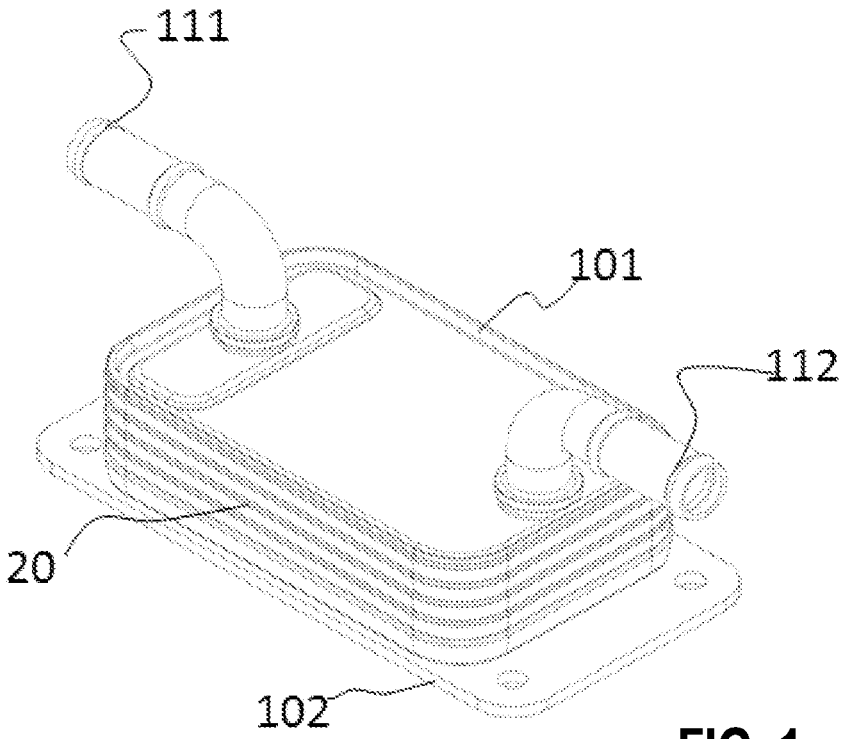
FIG. 1 is a structural diagram of a variable flow heat exchanger provided by some embodiments of the application.

As shown in FIGS. 1 to 9, in some embodiments, a variable flow heat exchanger is provided. The variable flow heat exchanger comprises a shell 10, which may also be referred to as a housing 10, and a heat exchange core 20 arranged on the shell 10. The shell 10 is provided with a fluid interface, which includes a cooling fluid interface and a cooled fluid interface.

Specifically, the shell 10 comprises a first shell 101, which may also be referred to as a first housing 101, and a second shell 102, which may also be referred to as a second housing 102. The heat exchange core 20 is arranged between the first shell 101 and the second shell 102, and the heat exchange core 20 is arranged by superposition of multi-layer heat exchange plates 201; The cooling fluid interface is arranged on the first housing 101, the cooled fluid interface is arranged on the second housing 102, and the cooled fluid interface includes the first interface 121, the second interface 122 and the third interface 123; That is, the first interface 121, the second interface 122, and the third interface 123 are all provided on the second housing 102.

The fluid interface can be divided into a fluid inlet and a fluid outlet for the fluid to flow from the fluid inlet to the fluid channel of the heat exchange core 20, and then flow out from the fluid outlet to realize fluid heat exchange. One or both of the first interface 121, the second interface 122 and the third interface 123 can be used as the inlet of the cooled fluid, and correspondingly, the other interfaces can be used as the outlet of the cooled fluid. Compared with the conventional cooler, the application adds fluid interfaces, which are connected with the vehicle cooling system through multiple fluid interfaces, and each interface can be redefined as inlet, outlet or closed according to the requirements of the cooling system; That is, according to the requirements of the cooling system, the positions of the cooled fluid inlet and the cooled fluid outlet in the application can be changed. Thus, in the variable flow heat exchanger of the present application, the cooled fluid can have at least two flow process states. For example, in the first state, the cooled fluid flows into the heat exchange core 20 from the first interface 121, and flows out of the second interface 122 after heat exchange through the fluid channels of the heat exchange plates 201 of each layer of the heat exchange core 20. In the second state, the cooled fluid flows into the heat exchange core 20 from the first interface 121 and the second interface 122 respectively, and flows out of the third interface 123 after heat exchange through the fluid channels of the heat exchange plates 201 of each layer of the heat exchange core 20.

In this embodiment, the variable flow heat exchanger may include a variable flow laminated oil cooler for cooling engine oil. The cooled fluid can be engine oil, and the cooling fluid can be various coolants, such as water. For the convenience of description, the embodiment of the application takes the oil cooler as the above heat exchanger as an example to specifically describe the variable flow program cooler. However, those skilled in the art will understand that the principle, fluid interface, heat exchange core and other settings of the invention can be realized in any appropriately arranged cooler (heat exchanger), which is not limited to the oil cooler, that is, the cooled fluid is not limited to the oil. In addition, for clarity and conciseness, the description of the well-known functions and structures of the cooler may be omitted.

In some embodiments, the heat exchange plate 201 is respectively provided with openings for the cooling fluid body and the cooled fluid to flow along the two longitudinal ends. After being assembled as the heat exchange core 20, the longitudinal fluid channel is formed.

Further, the heat exchange core 20 is respectively provided with a channel group A and a channel group B along both ends of the longitudinal direction. The heat exchange core 20 can be generally rectangular in shape as a whole, and channel group A and channel group B can be respectively arranged at both ends along the length direction of the heat exchange core 20. For example, channel group A and channel group B can be respectively arranged at the left end and the right end. Of course, in other embodiments, the heat exchange core 20 can also adopt other shapes and structures, and the specific shape of the heat exchange core 20 is not limited in this embodiment.

The channel group A includes a first channel 211, a second channel 212, and a third channel 213, which are sequentially spaced, and the second channel 212 is located between the first channel 211 and the third channel 213. The channel group B includes a fourth channel 214, a fifth channel 215 and a sixth channel 216 which are arranged at intervals in sequence. The fifth channel 215 is located between the fourth channel 214 and the sixth channel 216. A multi-layer fluid flow path 202 is arranged between the channel group A and the channel group B, and the fluid flow path 202 is connected with one or several channels and fluid interfaces in the channel group A and the channel group B, so that the cooled fluid, such as oil, enters one or several channels from the fluid inlet, and then flows through the fluid flow path 202, collects in one or several channels, and then flows out from the fluid outlet. The first channel 211, the second channel 212, the third channel 213, the fourth channel 214, the fifth channel 215 or the sixth channel 216 can play the role of collection and distribution. For example, some of the channels can be used for the collection and distribution of the cooled fluid such as engine oil, and the other part can be used for the collection and distribution of the cooling fluid such as coolant. The setting of multiple interfaces and channels can facilitate the change of fluid flow and the switching of different modes.

The shell 10 in this embodiment is provided with a plurality of interfaces. In order to facilitate the change of fluid flow, increase the speed of fluid to various positions, and improve the cooling effect of the cooler, the above interfaces need to be set corresponding to each channel. For example, the first interface 121 on the second housing 102 corresponds to the fourth channel 214 of the heat exchange core 20, the second interface 122 on the second housing 102 corresponds to the sixth channel 216 of the heat exchange core 20, and the third interface 123 on the second housing 102 corresponds to the second channel 212 of the heat exchange core 20. For example, the cooled fluid entering from the first interface 121 flows through the fourth channel 214, and the cooled fluid is distributed from the fourth channel 214 to each parallel fluid flow path 202.

The internal flow of the variable process heat exchanger in this embodiment can be changed, that is, the variable process heat exchanger can have different modes or states. In this embodiment, the positions of the fluid inlet and the fluid outlet are changed according to the requirements of the cooling system, and the switching between the two states can be realized. In the first state, the cooled fluid first enters the fourth channel 214 from the first interface 121, then the cooled fluid is distributed from the fourth channel 214 to each layer of fluid flow path 202, and the cooled fluid of each layer of fluid flow path 202 is collected to the sixth channel 216 and flows out from the second interface 122; In the second state, the cooled fluid first enters the fourth channel 214 and the sixth channel 216 from the first interface 121 and the second interface 122 respectively, and then the cooled fluid is distributed to each layer of fluid flow path 202 from the fourth channel 214 and the sixth channel 216 respectively. The cooled fluid of each layer of fluid flow path 202 is collected to the second channel 212 and flows out from the third interface 123.

In some embodiments, the cooled fluid in the first state forms a U-shaped flow pattern, and the cooled fluid in the second state forms a Y-shaped flow pattern.

In this way, this embodiment can realize mode switching according to the position change of fluid inlet and fluid outlet. Taking fluid flow path 202 (oil path) as an example, it can realize U-type flow and Y-type flow switching: the U-type flow mode can adapt to small flow conditions and improve heat exchange; Y-type flow mode can adapt to large flow conditions, reduce flow resistance, and thus reduce energy consumption.

It can be understood that, in order to realize the switching between the two states, the variable process heat exchanger needs to be equipped with control elements to guide the fluid in the system, such as oil medium, from the designated inlet and outlet positions to pass through the oil cooler. The embodiment does not limit the specific type or structure of the control element, as long as it can realize the change of inlet and outlet positions and does not limit the purpose of the invention.

The variable flow heat exchanger will be further described in detail below.

Figure 2:
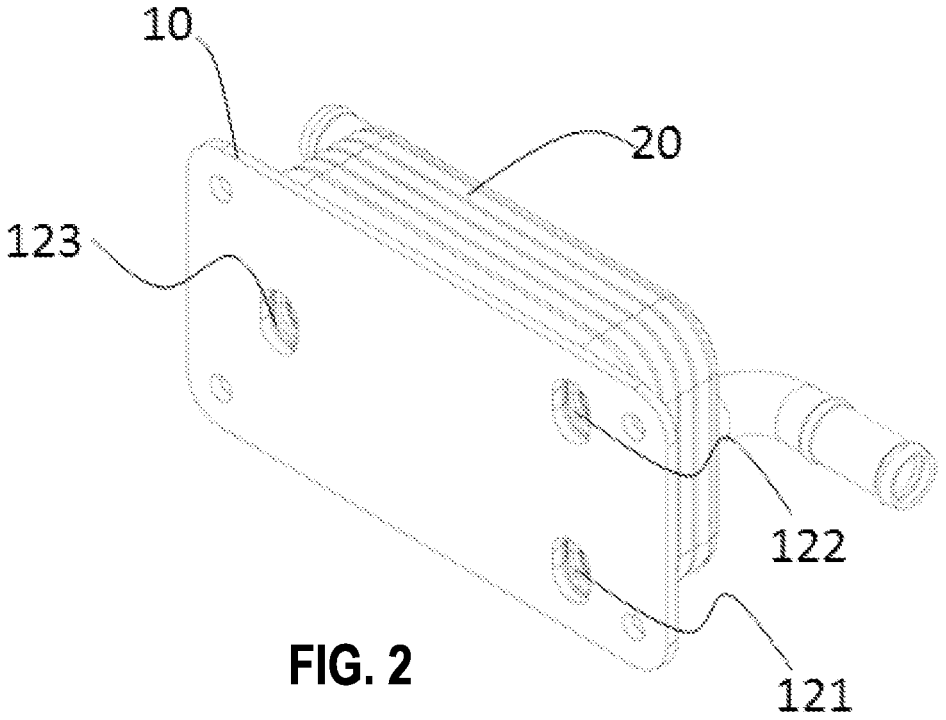
FIG. 2 is another view structure diagram of the variable flow heat exchanger provided by some embodiments of the application.

As shown in FIG. 1 and FIG. 2, in some embodiments, the first housing 101 is provided with a cooling medium inlet 111 and a cooling medium outlet 112, and a multi-layer coolant flow path 203 (i.e., a cooling medium flow path) is also provided between the channel group A and the channel group B. The following takes the cooling medium as the coolant as an example. The coolant flow path 203 is connected with one or more channels in channel group A and channel group B, as well as the coolant inlet 111 and the coolant outlet 112, so that the coolant enters one or more of the channels from the coolant inlet 111, then flows through the coolant flow path 203, collects in one or more of the channels, and then flows out of the coolant outlet 112. In the heat exchange core 20, the coolant exchanges heat with the cooled fluid such as engine oil, so that the engine oil is cooled by the coolant.

In some embodiments, the coolant includes but is not limited to water, that is, the medium flowing in the coolant flow path 203 may be cooling water, and the cooling water may be used to heat exchange the engine oil, but is not limited to this. In other embodiments, any other heat exchange medium capable of heat exchange for engine oil may also be used.

The first housing 101 is provided with a cooling medium inlet 111 and a cooling medium outlet 112. The cooling medium inlet 111 and the cooling medium outlet 112 are connected with a plurality of channels in the heat exchange core 20 and a coolant flow path 203. Alternatively, the cooling medium inlet 111 and the cooling medium outlet 112 may be respectively located at both ends of the first housing 101 along the longitudinal direction. For example, the cooling medium inlet 111 may be located at the left end of the first housing 101, and the cooling medium outlet 112 may be located at the right end of the first housing 101. Optionally, the cooling medium inlet 111 is connected with a water inlet joint, and the cooling medium outlet 112 is connected with a water outlet joint. Further, the cooling medium inlet 111 can be connected with a water system or a water pump in the vehicle through a water inlet joint to provide cooling water to the variable flow heat exchanger; The cooling medium outlet 112 is connected with another heat exchanger in the vehicle through a water outlet joint to input the water medium after heat exchange through the variable flow heat exchanger into another heat exchanger as the heat exchange medium of other heat exchangers.

The second shell 102 is provided with a first interface 121, a second interface 122 and a third interface 123, which can be connected with a number of channels and fluid flow paths 202 in the heat exchange core 20. The first interface 121, the second interface 122 and the third interface 123 need to be arranged at intervals in order to facilitate the position change of fluid inlet and fluid outlet, realize the switching of different modes, facilitate the import and export of cooled fluid, and ensure the heat exchange effect. For example, in some embodiments, the first interface 121, the second interface 122, and the third interface 123 are V-shaped on the second housing 102.

For example, the first interface 121 and the second interface 122 are located at both ends of the V-shaped opening, and the third interface 123 is located at the tip of the V-shaped opening. Optionally, one or both of the first interface 121, the second interface 122 and the third interface 123 are used as fluid inlets, and the fluid inlets are connected with the transmission or engine in the vehicle through pipelines; One of the first interface 121, the second interface 122 and the third interface 123 serves as a fluid outlet, and the fluid outlet is finally connected with the transmission or engine in the vehicle through a pipeline.

The heat exchange core body in this embodiment can be laminated, that is, the heat exchange core body 20 is formed by stacking the multi-layer heat exchange plates 201. In some embodiments, the heat exchange plate 201 is longitudinally provided with fluid fins for the cooling fluid and the cooled fluid to flow, and after being assembled as the heat exchange core 20, a multi-layer fluid channel is formed.

Optionally, the fluid flow path 202 and the coolant flow path 203 are distributed in an upper and lower layer; This helps to ensure the cooling effect of the coolant flow path 203 on the fluid flow path 202. Optionally, the heat exchange core 20 is provided with a multi-layer fluid flow path 202 and a multi-layer coolant flow path 203, and the fluid flow path 202 and the coolant flow path 203 can be alternately arranged. In this embodiment, the specific number of layers of the fluid flow path 202 and the specific number of layers of the coolant flow path 203 are not limited, and can be selected and set according to the actual heat exchange demand.

Figure 3:
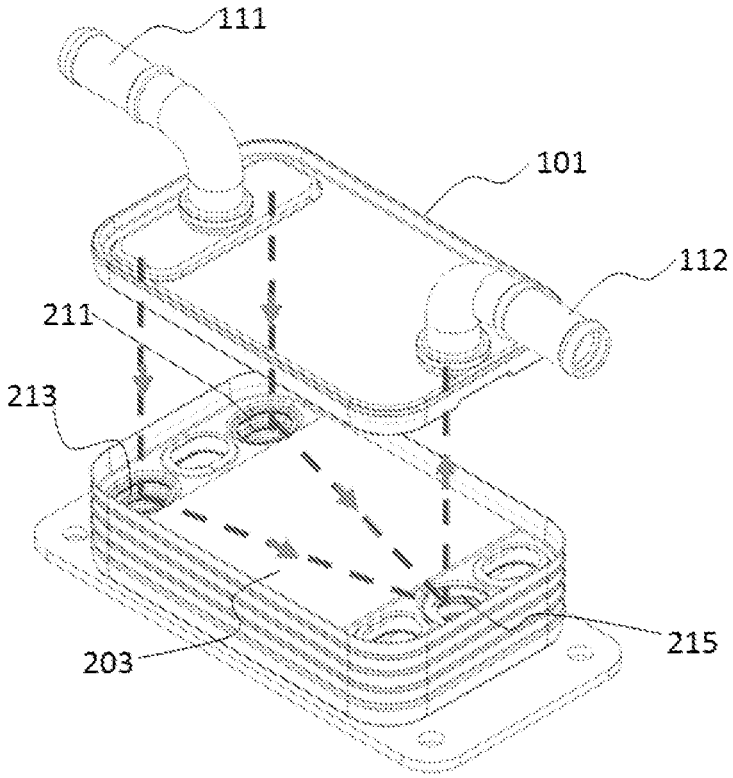
FIG. 3 is a flow diagram of the cooling fluid in the variable flow heat exchanger provided by some embodiments of the application.
Figure 4:
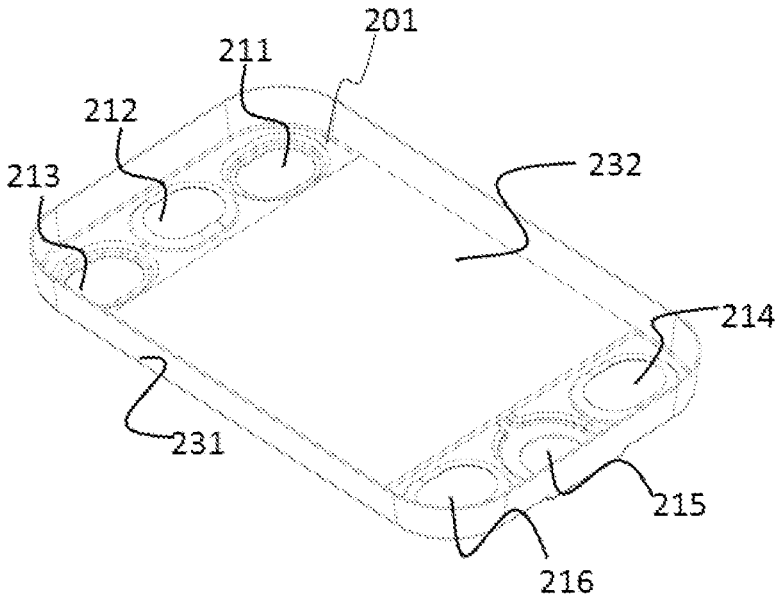
FIG. 4 is the structural diagram of the heat exchange plate in the variable flow heat exchanger provided by some embodiments of the application.

As shown in FIGS. 3 and 4, the arrows in FIG. 3 represent the flow direction of the coolant. In some embodiments, the cooling medium inlet 111 corresponds to the first channel 211 and the third channel 213, and the cooling medium outlet 112 corresponds to the fifth channel 215. The coolant first enters the first channel 211 and the third channel 213 from the cooling medium inlet 111, and then the coolant is distributed from the first channel 211 and the third channel 213 to each layer of the coolant flow path 203, and the coolant of each layer of the coolant flow path 203 is collected to the fifth channel 215 and flows out of the cooling medium outlet 112; That is, coolant such as cooling water enters the heat exchange core 20 through the cooling medium inlet 111 and then to the vertical channel; The first channel 211 and the third channel 213 distribute the water flow to the parallel coolant flow path 203 of each layer, then collect at the fifth channel 215 after passing through the coolant flow path 203 of each layer, and leave the variable flow heat exchanger from the cooling medium outlet 112. The coolant flow paths 203 of the above layers form parallel paths through the channels in channel group A and channel group B for coolant flow and heat exchange with engine oil.

In some embodiments, the heat exchange core 20 comprises a heat exchange plate 201, on which a cooling fluid assembly and a cooled fluid assembly are respectively arranged, the longitudinal ends of the heat exchange plate 201 are respectively provided with a channel group A and a channel group B, and the cooling fluid assembly and the cooled assembly can be located between the channel group A and the channel group B; The cooled fluid assembly is formed with a fluid flow path 202, and the cooling fluid assembly is formed with a coolant flow path 203.

Alternatively, the cooling fluid assembly includes a cooling plate 231 and cooling fins 232 connected to the cooling plate 231. The above coolant flow path 203 can be designed to form a flow channel for coolant flow by using the cooling plate 231 and the cooling fin 232.

Figure 5:
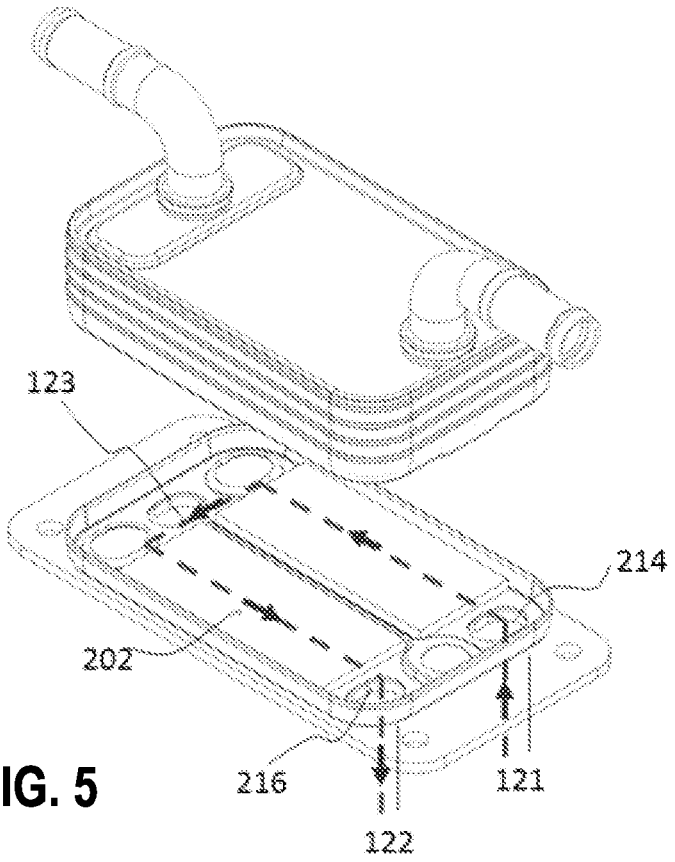
FIG. 5 is a flow diagram of the cooled fluid in the variable flow heat exchanger in the first state provided by some embodiments of the application.
Figure 6:
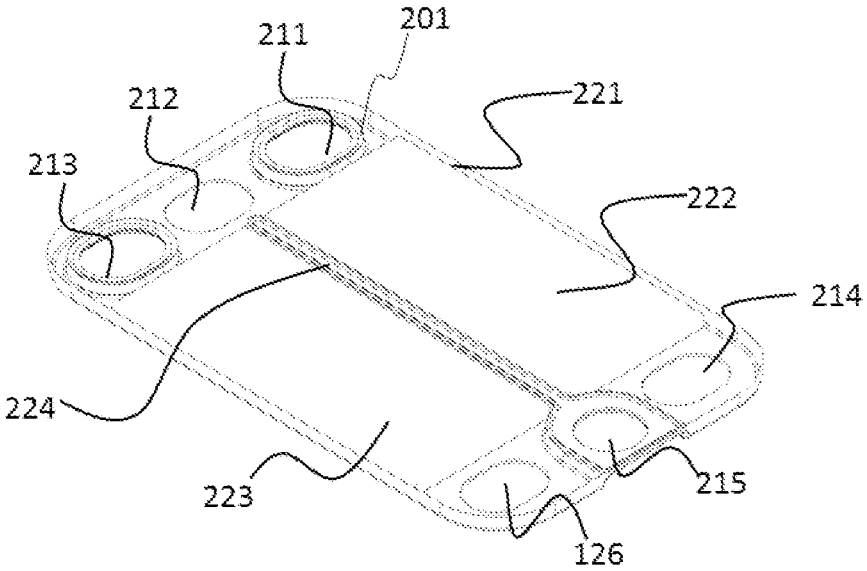
FIG. 6 is the structural diagram of the heat exchange plate and the cooled fluid assembly in the variable flow heat exchanger provided by some embodiments of the application.
Figure 7:
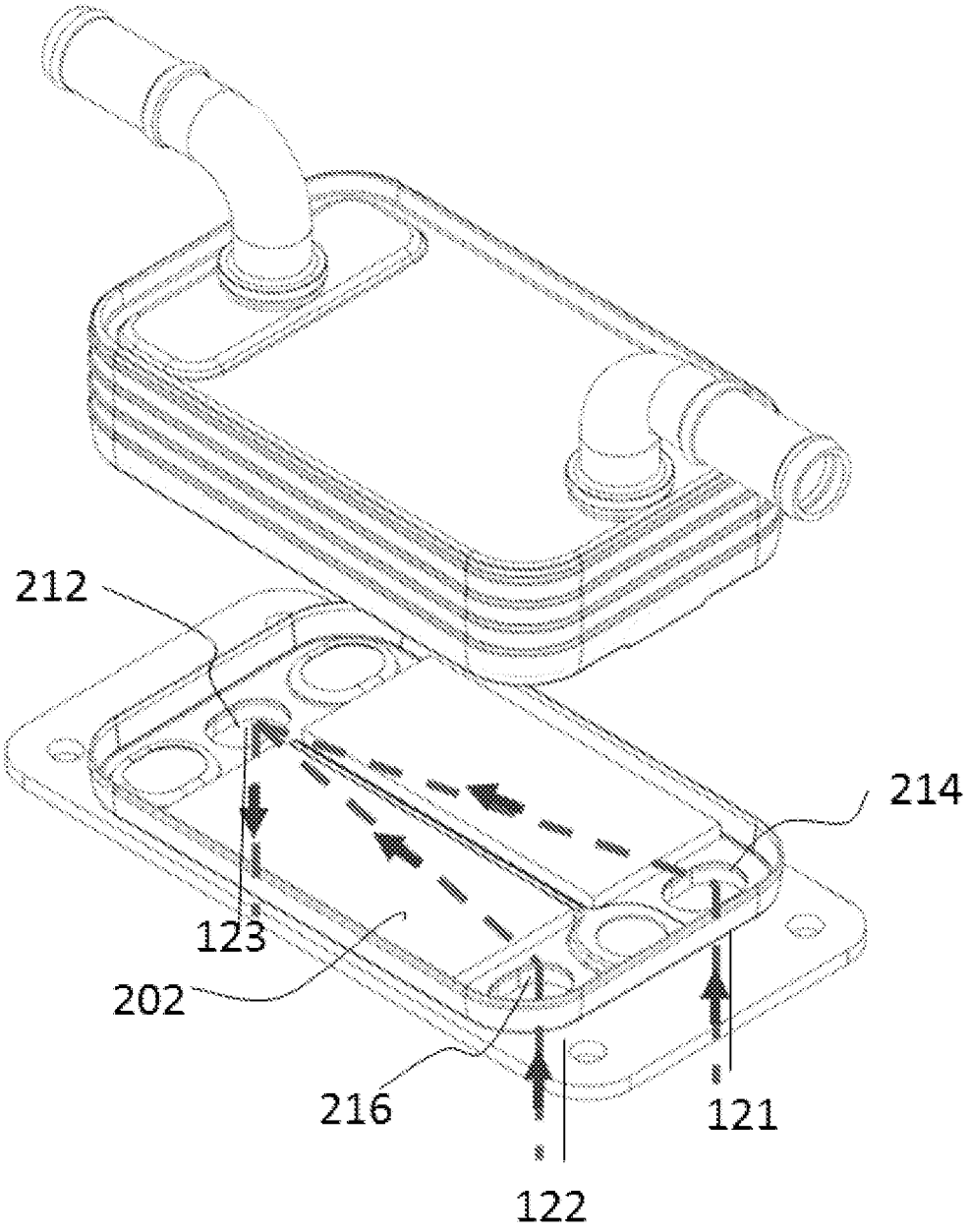
FIG. 7 is a flow diagram of the cooled fluid in the variable flow heat exchanger in the second state provided by some embodiments of the application.

As shown in FIGS. 5 to 7, the arrows in FIGS. 5 and 7 respectively represent the flow direction of the cooled fluid. The fluid flow path 202 of this embodiment adopts a variable inlet and outlet design, so that the cooled fluid can have different flow modes. In some embodiments, when the vehicle system working condition is in the low flow state, the variable flow heat exchanger can enter the u-flow mode, that is, the variable flow heat exchanger can be in the first state to increase the process to improve the heat exchange. As shown in FIG. 5, the cooled fluid first enters the fourth channel 214 from the first interface 121, and then the cooled fluid is distributed from the fourth channel 214 to each layer of fluid flow path 202. The cooled fluid of each layer of fluid flow path 202 is collected to the sixth channel 216 and flows out from the second interface 122. That is, the cooled fluid enters the heat exchange core 20 from the first interface 121 and then goes to the vertical channel. The fourth channel 214 distributes the cooled fluid to each parallel layer of fluid flow path 202, passes through each layer of fluid flow path 202, collects at the sixth channel 216, and leaves the variable process heat exchange system from the second interface 122. The third interface 123 in this state is not connected to the system.

As shown in FIG. 7, in some embodiments, when the vehicle system working condition is in the high flow state, the variable flow heat exchanger can enter the y-flow mode, that is, the variable flow heat exchanger can be in the second state to shorten the process and reduce the oil side flow resistance. In this state, the cooled fluid first enters the fourth channel 214 and the sixth channel 216 from the first interface 121 and the second interface 122 respectively, and then the cooled fluid is distributed to each layer of fluid flow path 202 from the fourth channel 214 and the sixth channel 216 respectively. The cooled fluid of each layer of fluid flow path 202 is collected to the second channel 212 and flows out from the third interface 123. That is, the cooled fluid enters the heat exchange core 20 from the first interface 121 and the second interface 122 at the same time and then goes to the vertical channel. The fourth channel 214 and the sixth channel 216 distribute the cooled fluid to each parallel layer of fluid flow path 202. After passing through each layer of fluid flow path 202 and collecting at the second channel 212, they leave the variable process heat exchange system from the third interface 123.

In this embodiment, the heat exchange plate 201 includes fluid components arranged on both sides, and the fluid components define the fluid flow path 202 of the fluid on the heat exchange plate 201. Optionally, the fluid assembly includes a cooling fluid assembly and a cooled fluid assembly. The cooled fluid assembly in the fluid assembly includes fins and partition ribs 224, which divide the fluid flow path 202 on the heat exchange plate 201 into at least two flow path areas; The fins include a first fluid fin 222 and a second fluid fin 223.

Alternatively, as shown in FIG. 6, the cooled fluid assembly includes a fluid plate 221, a first fluid fin 222 and a second fluid fin 223 connected to the fluid plate 221, and a partition rib 224 located between the first fluid fin 222 and the second fluid fin 223. The fluid flow path 202 may be designed to form a flow channel capable of flowing the cooled fluid by using the fluid plate 221, the first fluid fin 222 and the second fluid fin 223. In addition, a partition rib 224 can be formed between the first fluid fin 222 and the second fluid fin 223 by stamping, and the partition rib 224 can act as a partition so that the cooled fluid can form a U-shaped flow mode.

Figure 8:
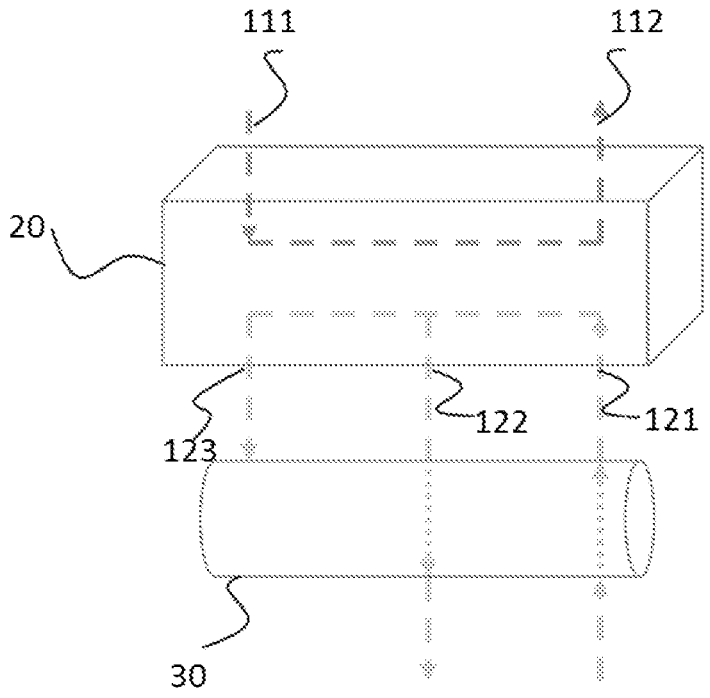
FIG. 8 is a schematic diagram of the connection between the fluid interface and the control device of the variable flow heat exchanger in the first state provided by some embodiments of the application.
Figure 9:
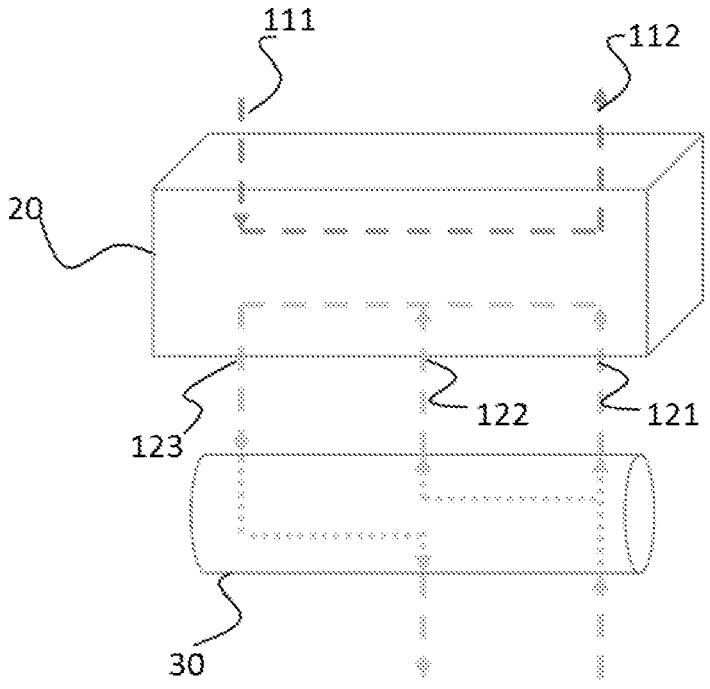
FIG. 9 is a schematic diagram of the connection between the fluid interface and the control device of the variable flow heat exchanger in the second state provided by some embodiments of the application.

As shown in FIGS. 8 to 9, in some embodiments, the variable flow heat exchanger also includes a control device 30. The first interface 121 is provided with a first valve, the second interface 122 is provided with a second valve, and the third interface 123 is provided with a third valve. The first valve, the second valve, and the third valve are electrically connected with the control device 30 respectively. The first interface 121, the second interface 122 and the third interface 123 are connected with the external control device 30, and the corresponding mode switching can be realized through the adjustment of the control device 30.

Optionally, the first valve, the second valve and the third valve can be one or more of the electronic temperature control valve, mechanical valve and thermal valve respectively. The specific types of the first valve, the second valve and the third valve are not limited in this embodiment.

In some embodiments, in the first state, the first valve and the second valve are electrically connected with the control device 30 respectively, so that the first interface 121 is used as the inlet of the cooled fluid, the second interface 122 is used as the outlet of the cooled fluid, and the third interface 123 is closed. That is, in the U-shaped flow mode, the first interface 121 is used as the inlet of the cooled fluid, the second interface 122 is used as the outlet of the cooled fluid to communicate with the control device 30, and the third interface 123 is closed or non-conductive. In the second state, the first valve, the second valve and the third valve are electrically connected with the control device 30 respectively, so that the first interface 121 and the second interface 122 are both used as the inlet of the cooled fluid, and the third interface 123 is used as the outlet of the cooled fluid. That is, in the y-flow mode, both the first interface 121 and the second interface 122 are connected with the control device 30 as the cooled fluid inlet, and the third interface 123 is connected with the control device 30 as the cooled fluid outlet.

In some embodiments, a power assembly is provided, including an engine and a transmission, and a variable flow heat exchanger, which is communicated with the engine and/or transmission.

The invention claimed is:

1. A variable flow heat exchanger, comprising:

a housing including a first housing and a second housing;

a heat exchange core arranged between the first housing and the second housing, the heat exchange core formed by superposition of multi-layer heat exchange plates;

a cooling fluid interface arranged on the first housing;

a cooled fluid interface arranged on the second housing, the cooled fluid interface including a first interface, a second interface, and a third interface; and a control device configured to adjust a state of the variable flow heat exchanger;

wherein the control device is configured to switch the variable flow heat exchanger into a first state in which a cooled fluid flows into the heat exchange core from the first interface and flows out of the second interface after heat exchange through a plurality of fluid flow passages of the heat exchange core;

wherein the control device is configured to switch the variable flow heat exchanger into a second state in which the cooled fluid flows into the heat exchange core from the first interface and the second interface, and flows out of the third interface after heat exchange through the plurality of fluid flow passages of the heat exchange core.

2. The variable flow heat exchanger according to claim 1, wherein each heat exchange plate of the heat exchange core includes a plurality of openings for a cooling fluid flow and a cooled fluid flow at both ends along a longitudinal direction, and after being assembled as the heat exchange core, form a longitudinal fluid channel.

3. The variable flow heat exchanger according to claim 2, wherein:

the heat exchange core includes a channel group A and a channel group B along both ends of the longitudinal direction;

the channel group A includes a first channel, a second channel, and a third channel successively arranged;

the channel group B includes a fourth channel, a fifth channel, and a sixth channel successively arranged;

the first interface corresponds to the fourth channel;

the second interface corresponds to the sixth channel; and the third interface corresponds to the second channel.

4. The variable flow heat exchanger according to claim 1, wherein:

the first interface includes a first valve;

the second interface includes a second valve;

the third interface includes a third valve; and the first valve, the second valve, and the third valve are electrically connected with the control device respectively.

5. The variable flow heat exchanger according to claim 4, wherein:

in the first state, the first valve and the second valve are electrically connected with the control device respectively such that the first interface forms an inlet for the cooled fluid, the second interface forms an outlet for the cooled fluid, and the third interface is closed; and in the second state, the first valve, the second valve, and the third valve are electrically connected with the control device respectively such that the first interface and the second interface both form an inlet for the cooled fluid and the third interface forms an outlet for the cooled fluid.

6. The variable flow heat exchanger according to claim 1, wherein each heat exchange plate of the heat exchange core includes longitudinal fluid fins for a cooling fluid and the cooled fluid, and after being assembled as the heat exchange core, form a multi-layer fluid channel.

7. The variable flow heat exchanger according to claim 6, wherein:

the heat exchange core includes a channel group A and a channel group B;

the channel group A includes a first channel, a second channel, and a third channel;

the channel group B includes a fourth channel, a fifth channel, and a sixth channel;

the cooling fluid interface includes:

a cooling fluid inlet corresponding to the first channel and the third channel; and a cooling fluid outlet corresponding to the fifth channel.

8. The variable flow heat exchanger according to claim 6, wherein each heat exchange plate of the heat exchange core includes a plurality of fluid components arranged on both sides, and the plurality of fluid components define a fluid flow path of a fluid on the respective heat exchange plate.

9. The variable flow heat exchanger according to claim 8, wherein a cooled fluid component of the plurality of fluid components includes a plurality of fins and partition ribs, and the plurality of fins and partition ribs divide the fluid flow path into at least two flow path areas.

10. A powertrain, comprising:

an engine;

a transmission; and the variable flow heat exchanger according to claim 1;

wherein the variable flow heat exchanger is connected with at least one of the engine and the transmission.

11. A variable flow heat exchanger, comprising:

a housing including a first housing and a second housing;

a plurality of heat exchange plates stacked on one another to define a heat exchange core, the heat exchange core arranged between the first housing and the second housing;

a cooling fluid interface arranged on the first housing;

a cooled fluid interface arranged on the second housing, the cooled fluid interface including a first interface, a second interface, and a third interface; and a control device configured to adjust a state of the variable flow heat exchanger;

wherein the control device is configured to switch the variable flow heat exchanger into a first state in which a cooled fluid flows into the heat exchange core via the first interface, exchanges heat, and then flows out of the heat exchange core via the second interface; and wherein the control device is configured to switch the variable flow heat exchanger into a second state in which the cooled fluid flows into the heat exchange core via the first interface and the second interface, exchanges heat, and then flows out of the heat exchange core via the third interface.

12. The variable flow heat exchanger according to claim 11, wherein:

the first interface includes a first valve;

the second interface includes a second valve;

the third interface includes a third valve; and the first valve, the second valve, and the third valve are each electrically connected with the control device.

13. The variable flow heat exchanger according to claim 12, wherein the control device is configured to adjust the first valve, the second valve, and the third valve such that:

when the variable flow heat exchanger is in the first state, the first interface forms an inlet for the cooled fluid, the second interface forms an outlet for the cooled fluid, and the third interface is closed; and when the variable flow heat exchanger is in the second state, the first interface and the second interface each form an inlet for the cooled fluid and the third interface forms an outlet for the cooled fluid.

14. The variable flow heat exchanger according to claim 11, wherein:

the plurality of heat exchange plates includes a plurality of first openings disposed at a first longitudinal end and a plurality of second openings disposed at a second longitudinal end; and the plurality of heat exchange plates define a plurality of longitudinal fluid passages.

15. The variable flow heat exchanger according to claim 14, wherein:

the heat exchange core includes a first channel, a second channel, a third channel, a fourth channel, a fifth channel, and a sixth channel;

the first channel, the second channel, and the third channel are successively arranged at the first longitudinal end and are each at least partially formed by a respective subset of the plurality of first openings;

the fourth channel, the fifth channel, and the sixth channel are successively arranged at the second longitudinal end and are each at least partially formed by a respective subset of the plurality of second openings;

the first interface is arranged corresponding to the fourth channel;

the second interface is arranged corresponding to the sixth channel;

the third interface is arranged corresponding to the second channel; and the cooling fluid interface includes:

a cooling fluid inlet corresponding to the first channel and the third channel; and a cooling fluid outlet corresponding to the fifth channel.

16. The variable flow heat exchanger according to claim 15, wherein:

the first interface includes a first valve;

the second interface includes a second valve;

the third interface includes a third valve;

the first valve, the second valve, and the third valve are each electrically connected with the control device; and the control device is configured to adjust the first valve, the second valve, and the third valve such that:

when the variable flow heat exchanger is in the first state, the first interface forms an inlet for the cooled fluid, the second interface forms an outlet for the cooled fluid, and the third interface is closed; and when the variable flow heat exchanger is in the second state, the first interface and the second interface each form an inlet for the cooled fluid and the third interface forms an outlet for the cooled fluid.

17. The variable flow heat exchanger according to claim 11, wherein the first interface and the second interface are arranged on a first side of the first housing and the third interface is arranged on an opposite, second side of the first housing.

18. A variable flow heat exchanger, comprising:

a housing including a first housing and a second housing;

a heat exchange core arranged between the first housing and the second housing, the heat exchange core formed by a plurality of stacked heat exchange plates;

a plurality of first fluid flow passages that each form a layer of a multi-layer first flow path for a cooled fluid;

a plurality of second fluid flow passages that each form a layer of a multi-layer second flow path for a cooling fluid, the plurality of first fluid flow passages and the plurality of second fluid flow passages each defined by and between a respective pair of adjacent plates of the plurality of heat exchange plates;

a cooling fluid interface arranged on the first housing;

a cooled fluid interface arranged on the second housing, the cooled fluid interface including a first interface, a second interface, and a third interface; and a control device configured to adjust a state of the variable flow heat exchanger;

wherein the control device is configured to switch the variable flow heat exchanger into a first state in which the cooled fluid flows into the heat exchange core via the first interface, is distributed to and flows through the plurality of first fluid passages, and flows out of the heat exchange core via the second interface; and wherein the control device is configured to switch the variable flow heat exchanger into a second state in which the cooled fluid flows into the heat exchange core via the first interface and the second interface, is distributed to and flows through the plurality of first fluid passages, and flows out of the heat exchange core via the third interface.

19. The variable flow heat exchanger according to claim 18, wherein:

the first interface includes a first valve, the first valve adjustable to a first interface inlet state in which the first interface forms an inlet for the cooled fluid;

the second interface includes a second valve, the second valve adjustable to i) a second interface inlet state in which the second interface forms an inlet for the cooled fluid and ii) a second interface outlet state in which the second interface forms an outlet for the cooled fluid;

the third interface includes a third valve, the third valve adjustable to i) a third interface closed state in which the third interface is closed and ii) a third interface outlet state in which the third interface forms an outlet for the cooled fluid; and the control device is electrically connected to the first valve, the second valve, and the third valve and is configured to adjust the first valve, the second valve, and/or the third valve to adjust the state of the variable flow heat exchanger.

20. The variable flow heat exchanger according to claim 18, wherein the plurality of first fluid flow passages each have a U-shaped flow pattern when the variable flow heat exchanger is in the first state and have a Y-shaped flow pattern when the variable flow heat exchanger is in the second state.

* * * * *